United States Patent [19]

Anderson

[11] 4,126,964

[45] Nov. 28, 1978

[54] PIVOTAL SLIDING SASH WINDOW

[76] Inventor: Ernest L. Anderson, Redmond, Wash. 98052

[21] Appl. No.: 831,380

[22] Filed: Sep. 8, 1977

[51] Int. Cl.[2] ..... E05D 15/22

[52] U.S. Cl. ..... 49/183

[58] Field of Search ..... 49/183, 176, 177, 178, 49/180

[56] References Cited

U.S. PATENT DOCUMENTS

| | | | |
|---|---|---|---|
| 2,559,212 | 7/1951 | Dilg | 49/183 |
| 2,731,684 | 1/1956 | Ruchin | 49/183 |
| 3,529,381 | 9/1970 | Grossman | 49/183 |

*Primary Examiner*—Philip C. Kannan

*Attorney, Agent, or Firm*—Seed, Berry, Vernon & Baynham

[57] ABSTRACT

A vertically sliding sash window is provided with elongated slide bars seated in recesses of the jambs with the elongated slide bars being pivotally connected to an upper end of the sliding vent of the window. The opposite end of the sliding vent is releasably locked to the slide bars. The sliding vent can thus be slid up and down as a conventional sliding sash window or be pivoted inward for cleaning.

8 Claims, 6 Drawing Figures

FIG. 1
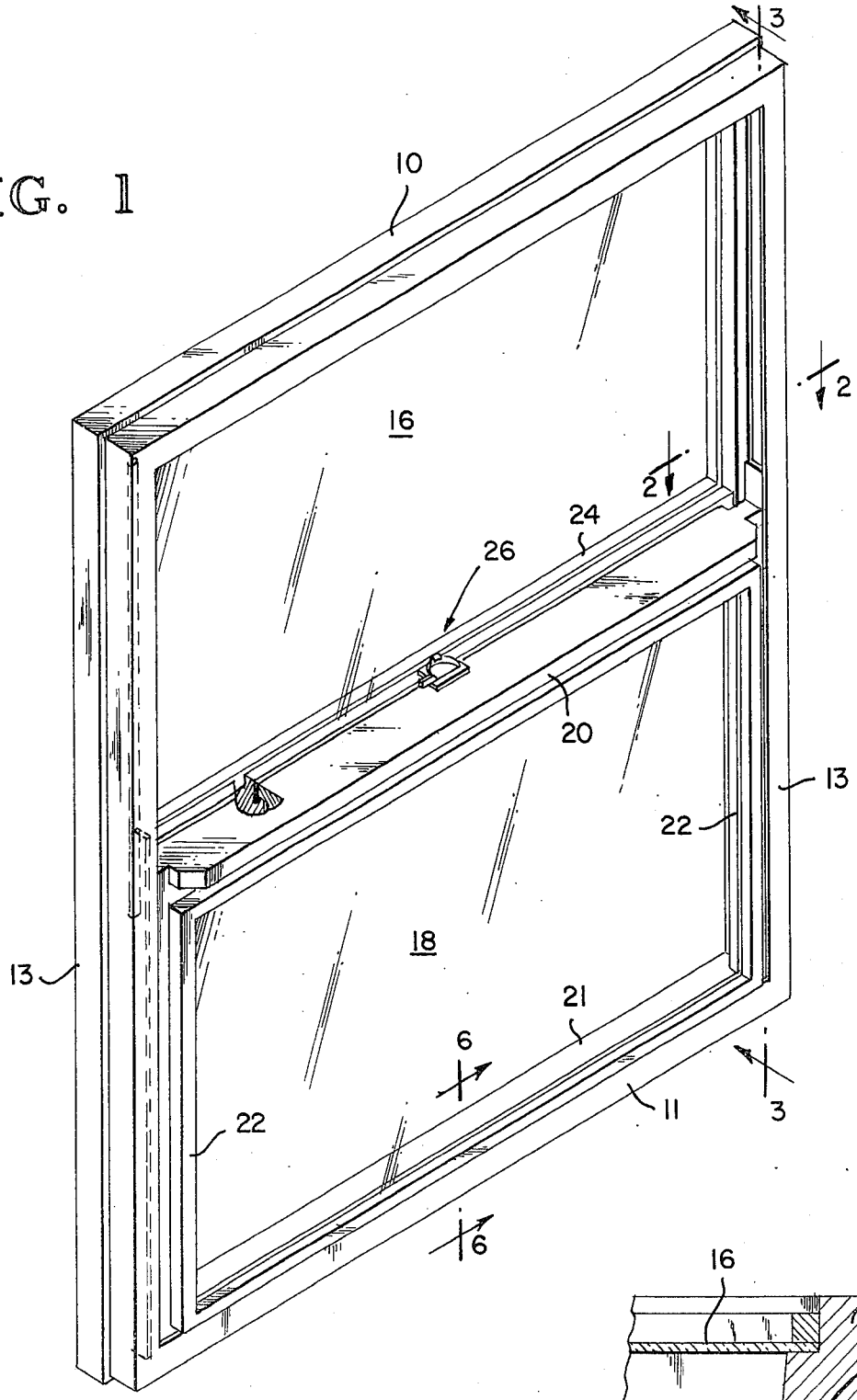
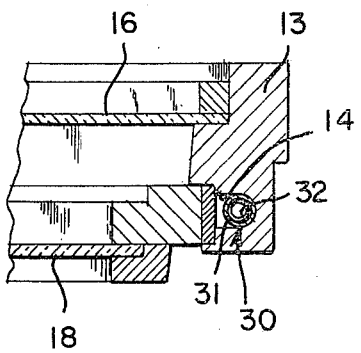
FIG. 2

PIVOTAL SLIDING SASH WINDOW

BACKGROUND OF THE INVENTION

1. Field of the Invention

This invention pertains to windows and, more particularly, to windows of the type having a sliding sash or movable vent.

2Description of the Prior Art

Both aluminum and wooden windows have provided single or multiple panes which are pivotally mounted in a stationary frame. The pivotal mounting has the advantage of providing access for cleaning both sides of the pane from the inside of the building. On the other hand, conventional wooden sash windows of the type in which the movable vent is slid upwardly in the window frame have generally had to be cleaned either from the outside or by a person sitting on the windowsill and leaning outside. In the latter situation it is difficult to reach all of the sliding pane.

SUMMARY OF THE INVENTION

It is an object of this invention to provide a sliding sash or vent window in which the movable vent may also be swung inwardly for cleaning of both of its sides.

It is another object of this invention to provide a unique pivotal mounting means for a sliding window.

Basically the objects are obtained by locating in a recess of opposite sides of the window frame, preferably the jambs, elongated sliding bars which are pivotally coupled to the first or interlock end of the movable vent so that the second opposite or outer end of the movable vent can be swung about the pivot making the outside of the movable vent accessible for cleaning from the inside. The second end of the movable vent is releasably locked to the frame. The invention in its broadest form is intended to encompass not only vertically slidable windows but also horizontally slidable windows. Secondly, the pivot may be at the outer end of the movable vent rather than at the interlock end while the advantages of the invention are best realized in a wooden window, the principles also are applicable to aluminum or other metal frame windows.

The unique pivotal mounting of the preferred embodiment of the invention includes elongated bars which ride in opposed recesses of the window frame and which receive pivot pins for pivotally connecting the movable vent to the window frame. The elongated bars also extend beyond the outer end of the movable vent so that releasable latching pins can be inserted into recesses in the extended elongated bars to lock the movable vent against pivoted movement. The latching pins are located in the plane of the movable vent so that they are substantially concealed thus enhancing the appearance of the window. The elongated bars preferably also extend upwardly beyond the interlock end of the movable vent to space the movable vent from the head of the window frame thus avoiding interference between the vent and the frame during swinging of the movable vent when it is in a raised position.

As is apparent the window provides ease of access for cleaning the movable vent on both sides from the inside of the building. With the unique pivotal mounting the movable vent can also be quickly and easily completely removed from the window frame, if desired, and yet is positively locked for security when left in the frame. From all appearances the window appears as a conventional attractive sliding sash window.

BRIEF DESCRIPTION OF THE FIGURES OF THE DRAWING

FIG. 1 is an enlarged isometric of a sliding, pivotal window embodying the principles of the invention with parts broken away for clarity.

FIG. 2 is a horizontal fragmentary section taken along the line 2—2 of FIG. 1 showing the movable vent 18 in an elevated position.

DETAILED DESCRIPTION OF THE PREFERRED EMBODIMENTS

Figure 5:
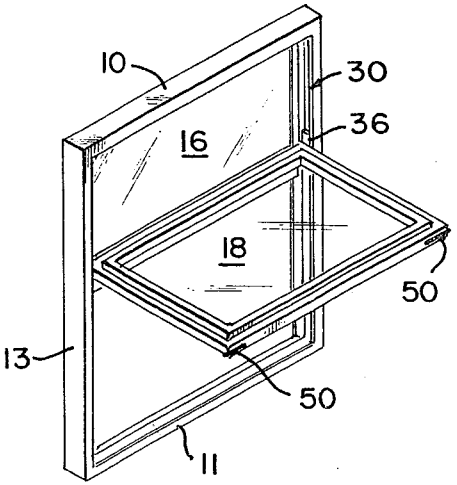
FIG. 5 is a perspective of the window shown in FIG. 1 with the movable vent pivoted into the open position.
Figure 6:
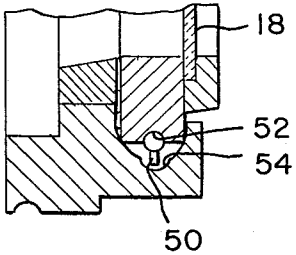
FIG. 6 is a fragmentary section taken along line 6—6 of FIG. 1.
Figure 3:
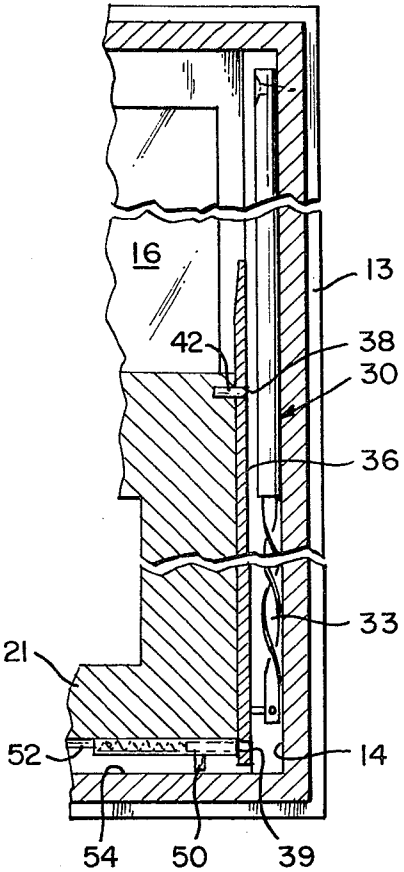
FIG. 3 is an enlarged vertical section taken along the line 3—3 of FIG. 1.
Figure 4:
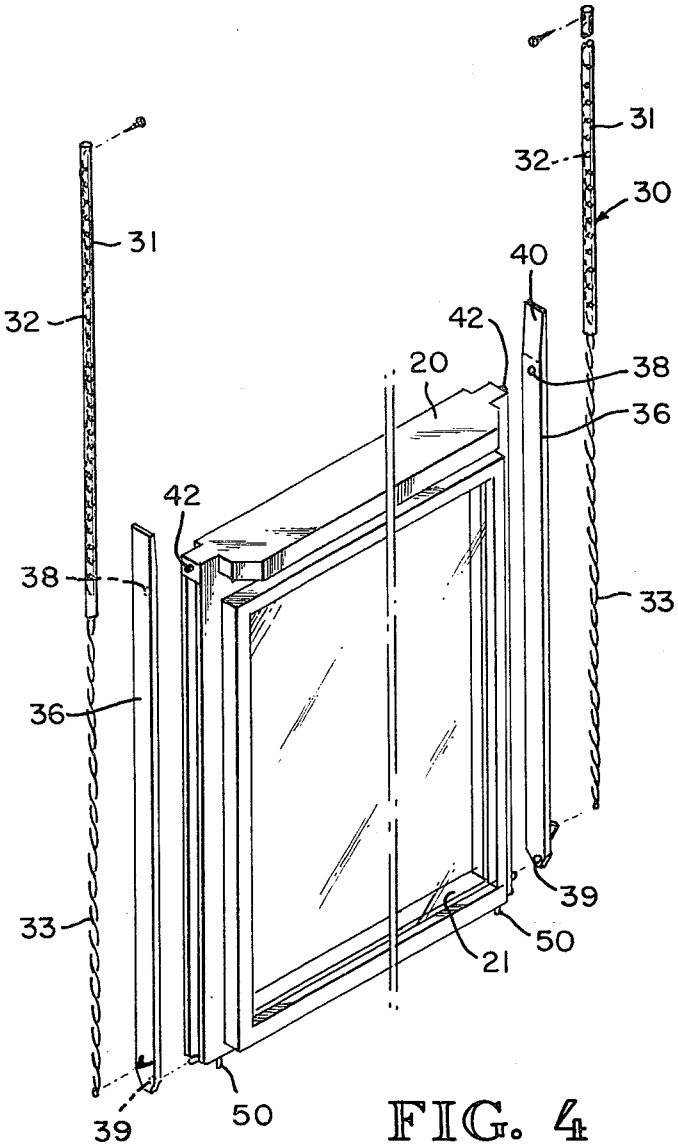
FIG. 4 is an exploded isometric of a portion of the window shown in FIG. 1.

A window frame having a head 10 and a sill 11 is joined by a pair of jambs 13. The head, jambs and sill each have a recess 14 which receives the frame of a fixed vent 16 and a slidable or movable vent 18. The movable vent for purposes of description will be defined as having an inner or interlock frame piece 20, an outer frame piece 21 and a pair of side pieces 22. The fixed vent will be defined as having an inner or interlock frame piece 24 but with its remaining peripheral edges being sealed directly to the jambs and head. A conventional wedge bolt 26 locks the two interlock frame pieces 20 and 24 together in a conventional manner.

The window is also provided with spring counterbalances 30 and 31 which include slotted tubes 31 which are attached to the jambs in the recesses 14. The tubes each contain a torsion spring 32 which is coupled to a spiral rod 33. As the spiral rod passes through the slotted end of the tube 31 it rotates the slotted end which is coupled to the spring thus twisting the spring to store energy. That is, as the window is lowered the spring is twisted but as the window is raised the weight of the window is offset by the energy stored in the spring. As thus far discribed, the spring counterbalances are conventional. It is a unique feature of this invention, however, that these counterbalances are modified to provide a pivotal attachment for the movable vent. For this purpose, the movable vent is provided with a set of opposite elongated bars 36 each having a pivot pin opening 38 adjacent the interlock piece 20 and a locking pin recess 39 adjacent the outer frame piece 21. Each elongated bar has an inner extension 40 which spaces the interlock frame piece 20 from the head 10 of the window frame so that when the movable vent is swung outwardly about the pivot pin opening 38 the interlock frame piece 20 will not engage the head 10. The interlock frame piece 20 is provided with pivot pins 42. These pins are inserted in the pivot pin openings of the elongated bars by sliding the elongated bars vertically out of alignment with one another so that the distance between the openings 38 is greater than the distance between the outer extremeties of the two pins 42. Then the pins 42 are aligned with the recesses 38 and the elongated bars returned into alignment with one another so that the pivot pins move into the recesses 38.

The movable vent 18 is latched against swinging movement by spring detents 50 which engage in locking recesses 39. Each spring detent is partially concealed in a groove 52 running along the lower edge of the movable vent frame piece 21. This groove 52 when the movable vent is closed opposes an upwardly opening groove 54 in the sill 11 so that when the movable vent is in its downwardly closed position it is impossible to detect the spring detent 50. Thus when the window is locked the spring detent remains secure and concealed.

In operation the window is first unlocked in a conventional manner by opening the lock 26. The window then can be slid upwardly as a normal sliding sash window. To clean the rear surface of the movable vent 18 the spring detents are pulled inwardly out of the locking openings 39 and the movable vent is swung into the position shown in FIG. 5. After cleaning the movable vent is restored to its original position in the outer window frame and the spring detents 50 latched.

While the preferred embodiment of the invention has been illustrated and described it should be understood that variations will be apparent to one skilled in the art. Accordingly the invention is not to be limited to the specific embodiment shown in the drawings.

I claim:

1. A slidable sash window comprising a frame having a sill with an upwardly opening groove, a head and opposed jambs, the jambs joining the head and sill having glass-containing frame portions and sealing surfaces protruding inwardly in the plane of said window, a fixed vent and a movable vent having first and second opposite ends and a track in each of said jambs for slidably guiding the movable vent, the improvement comprising:

opposite pivotal means for pivotally mounting the movable vent in said jambs, said movable vent having opposite side pieces opposed to and adapted to abut said sealing surfaces of said jambs, an inner frame piece and an outer frame piece, one of said frame pieces having an extension in the plane of said movable vent and having a reduced thickness perpendicular to said plane of said movable vent and thus spaced from said glass-containing portions of said jamb, said pivotal means each including slide means mounted in said track, weight counterbalancing means coupled to said slide means for counterbalancing the weight of the movable vent, pivot members attached to said reduced thickness extension for pivotally coupling a first of said opposite ends of the movable vent to said slide means whereby the second opposite end of the movable vent is swingable outwardly from the window frame for cleaning without interference with the jamb glass-containing portions, said movable vent being nested within said upwardly opening groove when in a lowermost position, and means for releasably locking the second opposite end against said swinging movement.

2. The window of claim 1, wherein said jambs are adapted for upright placement.

3. The window of claim 1, wherein said first opposite end of the movable vent is generally in the center of the window frame and the swingable second opposite end of the movable vent is adjacent the sill.

4. The window of claim 1, said slide means including elongated bars each of a length less than the length of said track by an amount sufficient to allow offset sliding of the opposite bars for laterally removing the pivot members from the bars for removal or replacement of the movable vent.

5. The window of claim 1, said slide means including elongated bars each having an extension beyond the first opposite end of the movable vent for precluding sliding movement of the movable vent against the window frame whereby the movable vent can swing open without interference between the movable vent first opposite end and the window frame.

6. A slidable sash window comprising a frame having a sill, head and opposed jambs joining the head and sill, a fixed vent and a movable vent having first and second opposite ends and a track in each of said jambs for slidably guiding the movable vent, the improvement comprising:

opposite pivotal means for pivotally mounting the movable vent in said jambs, said pivotal means each including slide means mounted in said track, weight counterbalancing means coupled to said slide means for counterbalancing the weight of the movable vent, pivot members for pivotally coupling a first of said opposite ends of the movable vent to said slide means whereby the second opposite end of the movable vent is swingable outwardly from the window frame for cleaning, and means for releasably locking the second opposite end against said swinging movement, said slide means including elongated bars each extending beyond the second opposite end of the movable vent, means for providing a locking recess in said elongated bar extension and wherein said releasable locking means includes pin means on said movable vent engageable in said locking recesses.

7. The window of claim 4, said elongated bars each having a length less than the length of the track by an amount sufficient to allow offset sliding of the opposite elongated bars for laterally removing the pivot members from the bars for removal or replacement of the movable vent and said bars each having an extension beyond the first end of the movable vent for spacing the first end from the head so that the movable vent can swing without interference with the head.

8. A slidable vent window comprising a frame having two opposed side frames and opposite first and second end frames, said second end frame having an inwardly facing recess opening toward said first end frame, a fixed vent and a movable vent having first and second opposite ends, and a track in two opposed window side frames for slidably guiding the movable vent, the improvement comprising said first opposite end of said movable vent having an interlock extension with opposite lateral edges of reduced thickness such that the edges are spaced from the fixed vent to allow free pivotal movement of the movable vent, opposite pivotal hanger means for pivotally mounting the movable vent in said opposed window side frames, said pivotal hanger means each including slide means mounted in said track, pivot means attached to said opposite ends of said interlock extension for pivotally coupling the inner end frame of the movable vent to said slide means whereby the outer end of the movable vent is swingable outwardly from the window frame for cleaning and means for releasably locking the outer end frame to said slide means to hold the movable vent against said swinging movement, said movable vent being slidably fitted within said inwardly facing recess of said second end frame for concealing the second opposite end of the movable vent.

* * * * *